United States Patent [19]

Pollner

[11] 4,097,977

[45] Jul. 4, 1978

[54] METHOD TO ATTACH THE CENTER ELECTRODE INTO A CERAMIC INSULATOR BODY OF SPARK PLUGS

[75] Inventor: Rudolf Pollner, Bamberg, Fed. Rep. of Germany

[73] Assignee: Robert Bosch GmbH, Stuttgart, Fed. Rep. of Germany

[21] Appl. No.: 807,872

[22] Filed: Jun. 20, 1977

[30] Foreign Application Priority Data

Jun. 25, 1976 [DE] Fed. Rep. of Germany ..... 2628667

[51] Int. Cl.[2] ..... H01T 13/00

[52] U.S. Cl. ..... 29/25.12; 425/125; 425/DIG. 44; 264/61; 264/67; 264/278; 264/314

[58] Field of Search ..... 425/DIG. 44, 405 H, 425/125; 264/314, 278, 61, 67; 29/25.12

[56] References Cited

U.S. PATENT DOCUMENTS

| | | | |
|---|---|---|---|
| 1,984,724 | 12/1934 | Birr | 425/125 |
| 2,091,973 | 9/1937 | Fessler et al. | 425/DIG. 44 |
| 2,152,738 | 4/1939 | Jeffery | 425/DIG. 44 |
| 3,034,191 | 5/1962 | Schaefer et al. | 425/DIG. 44 |

*Primary Examiner*—Richard B. Lazarus
*Attorney, Agent, or Firm*—Flynn & Frishauf

[57] ABSTRACT

To permit simple manufacture and reliable attachment of the center electrode into a ceramic body, an elastic tubular press mold is located in a press body, the press mold being closed off by a movable plug having a needle-like extension with a gripping end formed thereon to receive the center electrode before the plug is inserted into the tubular mold. Ceramic material is then filled into the mold, the plug closing off one end thereof, the mold is closed with a second plug, and pressure in the order of from 250 to 400 bar applied to the outside of the elastic mold to compress the ceramic material and embed the center electrode tip therein. Upon release of pressure, the compressed ceramic, with the center electrode therein can be removed from the holding tip of the needle-like extension of the plug, for subsequent grinding to size, sintering, firing, and glazing, if desired.

8 Claims, 6 Drawing Figures

Figure 1:
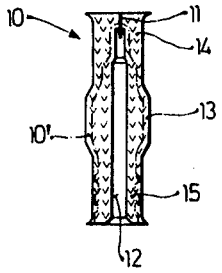

METHOD TO ATTACH THE CENTER ELECTRODE INTO A CERAMIC INSULATOR BODY OF SPARK PLUGS

Prior art relating to the subject matter of the present invention: U.S. Pat. No. 2,152,738; German Pat. No. 131,431.

The present invention relates to a method to secure a center electrode in a ceramic insulating tip or bushing of spark plugs for internal combustion engines, in which an electrically conductive spark tip is inserted in an insulating ceramic bushing or sleeve.

BACKGROUND OF THE INVENTION AND PRIOR ART

It has previously been proposed to provide a ceramic insulating sleeve or bushing forming the spark plug tip exposed to combustion gases and adapted for location within the combustion chamber of an internal combustion engine of ceramic material, in which a center electrode is inserted in a longitudinal bore or opening formed in the insulating tip. The sparking tip, of metal, was inserted into the ceramic insulator before the insulator was fired, and the combination of unfired insulator ceramic, typically a press-extruded element, and the center electrode were then sintered.

The result is a combination of spark plug insulator tip and center electrode — described, for example, in German Pat. No. 131,431 — in which the center electrode is inserted. In manufacture, the insulating mass, while of dough-like consistency, has the insulating tip inserted therein and, thereafter, the combination of tip and ceramic dough-like material is sintered. Such a method is not specially adapted for mass production of spark plugs. It has also been proposed — see U.S. Pat. No. 2,152,738 — to make intermediate extruded pressed spark plug insulators by isostatic press extrusion of insulating material. Simultaneous insertion, under force, of a center electrode in a preformed press body has not, however, previously been considered.

It is an object of the present invention to facilitate and speed the method of manufacturing spark plug tips, and more particularly to render the method of manufacture more economical and to provide a resulting product which does not permit existence of an air gap between the center electrode and the insulator and thus provide for efficient heat transfer, over long lifetime, of heat from the center electrode to the ceramic material.

Briefly, in accordance with the present invention, a series of steps in the method are carried out in which, first, a movable plug element with a needle-like extension formed at the end thereof has the center electrode tip inserted therein. The movable plug element is axially movable, for example by being attached to a vertically movable press plug. The press plug is movable in an elastic, tubular press mold made, for example, of rubbery material or the like, and which can be compressed from the outside by application of hydraulic pressure, pneumatic pressure, or the like. The plug element is inserted into the rubbery press form and shifted therein until the plug closes off one end of the tubular press form. A predetermined quantity of pulverized or granular ceramic material is then filled through the upper opening of the tubular press form, the opening is then closed by an upper plug, and the entire system is pressurized from the outside so that the rubbery elastomer mold transfers the outside pressure to the insulator press element and shapes the insulator press element; the pressure from the outside is then released, the press form opened and the lower plug removed. The lower plug will then have the needle-like extension with the center electrode still inserted therein and the ceramic press element secured thereto. The ceramic press element is then removed, together with the sparking tip from the needle-like extension. The center element will remain in the end portion of the ceramic element which, later on, will form the spark tip of the spark plug.

The apparatus to carry out the method, includes the movable plug which has, at its end portion, the needle-like extension which is formed with a bore to receive the sparking tip of the spark plug, which is so dimensioned and arranged that it can hold the tip of the spark plug. The needle-like extension itself, when withdrawn from the interior of the press form will leave a longitudinal hollow space or bore within the press form to permit later inclusion of a conductor therein to conduct electricity from the connection element of the spark plug to the spark tip.

The resulting spark plug tip - ceramic insulator assembly can be made economically, and the center electrode tip is inserted in the insulator tightly and without cracks, fissures, or gaps between the metallic tip and the insulating material. Heat transfer from the insulating tip to the surrounding ceramic material is thus excellent, the heat transfer rate remaining constant over long operating time of the spark plug. Spark plugs made in accordance with the method and with the apparatus as aforesaid are particularly suitable as test spark plugs.

Drawings, illustrating an example:

FIG. 1 is a schematic cross-sectional view through an insulator press form with a center electrode embedded therein, to greatly reduced size. The press form, as received after the method has been carried out and as later on ground to size is shown — the ground dimension being illustrated in chain-dotted lines; and FIGS. 2 through 6 are exploded views, in longitudinal section, through an apparatus to carry out the method in accordance with the present invention and illustrating sequential steps in the manufacture of the spark plug tip shown in FIG. 1, and also shown to a greatly reduced scale.

The insulator press body 10 (FIG. 1) is made of pulverized or granular ceramic, for example aluminum oxide, which may have additives permitting glazing. The material itself is standard and well known in the art. The center electrode 11 is inserted therein during the manufacturing process. The inner terminal end portion of the center electrode 11 extends into a longitudinal opening or bore 12 formed in the insulator press; the terminal end portion can then be electrically connected with a suitable connecting bolt in known manner durng assembly of the spark plug into a socket and housing.

The center electrode 11 may, for example, consist essentially of platinum or may be of other materials; it has a diameter of 0.5 mm. Damage to the insulator due to differences in coefficient of expansion of the center electrode 11 and of the ceramic material of the ceramic tip 10 is not a problem with such small diameters of a platinum center electrode. The center electrode 11 may also be made of electrically conductive ceramic or of a suitable Cermet. The requirements for the center electrode are that the material must be sufficiently heat resistant so that it does not melt upon sintering or firing of the outside ceramic or, due to heat upon grinding of the press body 10 to the profile shown in chain-dotted line at 10' softens or changes its electrically separate characteristic from the outside ceramic. Essentially, the center electrode should neither melt together with the ceramic material nor form melt phases in which the insulating properties of the ceramic press are undesirably affected by diffusion of conductive material from the tip into the ceramic.

The center portion of the press body 10 is formed with an essentially cylindrical bulge 13; the two end portions of the ceramic sleeve 10 are shown at 14, 15, in which the tip 14 forms the sparking end, exposed to the combustion gases in the cylinder head of an internal combustion engine.

The method of manufacture of such a press body, which is shown in its raw form at 10 and in its finished ground form with the chain-dotted dimension line 10', is best understood by reference to FIGS. 2 to 6, showing sequential steps.

The apparatus 16 of FIGS. 2 to 6 has a pressure resistant housing 17 with a longitudinal bore or opening 18 therein. Preferably, the longitudinal bore 18 extends vertically. It is closed off at the top and bottom by a ring nut 19, 20, respectively, leaving central openings 21, 22 through the respective nuts. The central bore 21 of nut 19 is externally flared to form a loading funnel 23 for ceramic material 24 (FIG. 3) to be introduced therein. A cross bore 25 extends into the central opening of the housing 17, and has attached thereto a duct 26 connected to a source of controlled pressure schematically indicated by letter P. The pressure may be hydraulic or pneumatic and should be capable of providing a compression pressure of at least 250 bar, and preferably more.

The ring nuts 19, 20 are screwed to engage a tubular press form made of an elastomer, typically rubber, or rubbery elastic material. The press form 27 defines a compression space 28 of predetermined configuration, matched to the raw shape of the press element or press body 10. The region of the bulge 13 of the press body is defined by an expansion 29 within the inner surface of the elastic tube 27. In half cross section, the expansion 29 is generally trapeze shaped. The end portions of the elastic mold 27 are formed with flanges 30, 31, respectively. The diameter of the mold area 28 of the end portions corresponds roughly to the diameter of the central bores 21, 22 in the end ring nuts 19, 20. A supporting basket 32 is located in the longitudinal bore 18 of housing 17 to surround the rubbery mold 27 and to support the outer circumference of the mold. The basket 32 is highly perforated, schematically shown by a plurality of openings 33, and is so shaped that the inside 34 thereof engages the outside of the elastic mold 27. Between the outside 35 of the basket, however, and the bore 18 in the press form 17, a duct or chamber 36 is left free, communicating with the opening 25 and hence with pressure source connection 26. Preferably, the pressure source is a hydraulic system and can, therefore, provide hydraulic pressure through duct 26, cross bore 25 in the housing, duct or chamber 36 within the body 17 and through the opening 33 in basket 32 to provide uniform circumferential pressure on the mold 27.

An upper movable plug 37 is vertically movable with respect to the body 17. A lower movable plug 38 can be inserted through opening 22 into the mold. The plugs 37, 38 are moved, preferably by hydraulic pressure, and with a suitable timing control. The upper plug 37 is arranged to extend into the bore 21 of nut 19 or to be moved upwardly into a rest position in which it is spaced by a sufficient distance from the filling funnel 23. The upper plug 37 is formed with a head ring 39 which has a diameter which corresponds to the diameter of the bore 21 in upper nut 19.

The lower plug 38 has a head ring 40 which has a diameter corresponding to the diameter of the central bore 22 in the lower nut 20. It can be moved through the entire inner space 28 of the elastic press mold 27 and through the opening 21 of the upper nut 19; or it can be moved downwardly to be entirely removed from the space or chamber 28. The head element 40 of the lower plug 38 has a press needle extension 42 projecting from its front surface 41. The needle-like extension 42 is provided to form the longitudinal bore or opening 12 (FIG. 1) of the ceramic press body to be formed in the process. The end portion 43 of the needle 42 has a bore 44 formed therein which is arranged and dimensioned to hold the connecting end of the center electrode 44. The depth of this bore 44 corresponds to that length of the center electrode 11 which is required to provide contact of the center electrode tip 11 with a connecting element such as a connecting bolt of the spark plug, when it is finally bolt. This connecting element or bolt is well known and not shown in the drawing, for simplicity.

A supply 45 (FIG. 3) is provided to supply pulverized or granular insulating material. The entire apparatus is held in a suitable frame or fixture (not shown); it further includes the necessary hydraulic or other movable element and apparatus to hold, move and control the sequential steps and movements to be described.

Figure 2:
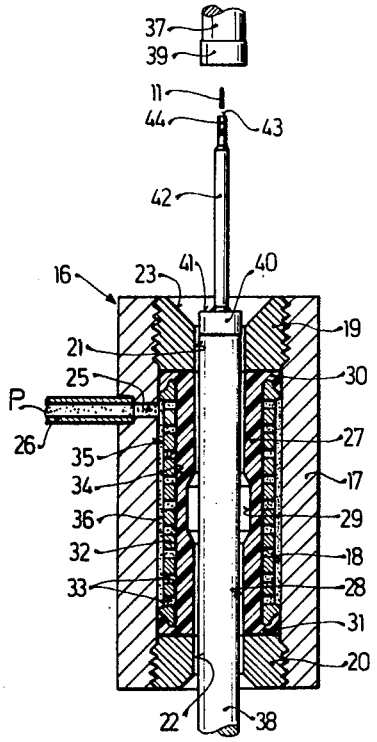

Operation of the apparatus, and process of making the spark plug press body: The first step is shown in FIG. 2. The upper plug 37 is withdrawn high above the insertion funnel 23 of the housing 17. The lower plug 38 is upwardly extended through the mold so that the needle 42 will extend upwardly from the body 17. The head front surface 41 extends into the fill funnel 23. The press needle 42 extends out from the fill funnel 23. It is also possible to use as a starting position a location for the lower plug 38 in which the lower plug together with the needle 42 is entirely removed, that is, drawn downwardly in FIG. 2 from the form 17. In the first stage, the lower plug 38 then will be below housing 17 with the elastic press form 27. The pressure connection 26 is filled with a suitable hydraulic fluid which, however, is at ambient atmospheric pressure and is not pressurized. The elastic press form 27 is not deformed.

As a first step, a center tip electrode 11 is inserted into the opening 44 of needle 42 and secured therein to be held into the bore 44.

Figure 3:
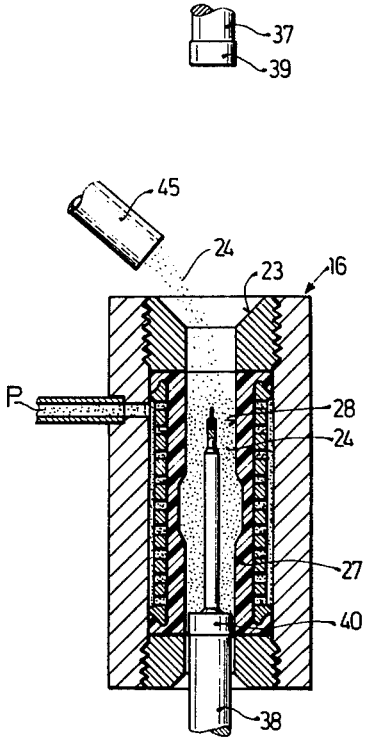

The second step is shown in FIG. 3. The lower plug 38 is moved into the mold so that its head ring 40 is about flush with the lower portion of the elastic press form 27. The position is shown in FIG. 3. Thereafter, granular or pulverized or powdered ceramic material 24 is filled through the funnel 23. The quantity of ceramic material is premeasured, to entirely fill the space 28 within the elastic mold 27.

Figure 4:
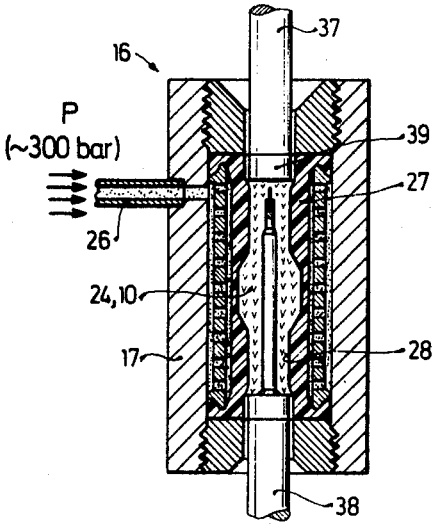
Figure 6:
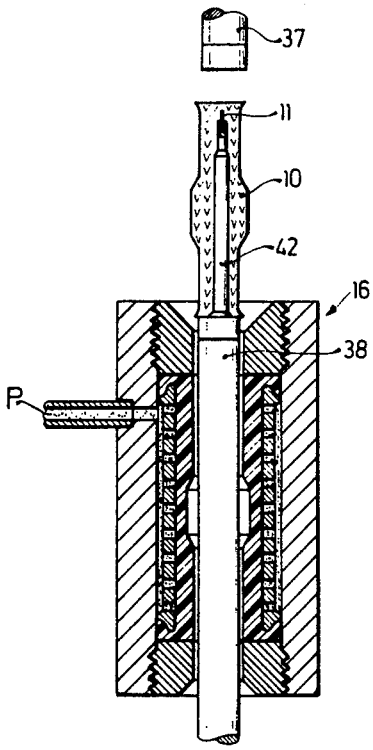
Figure 5:
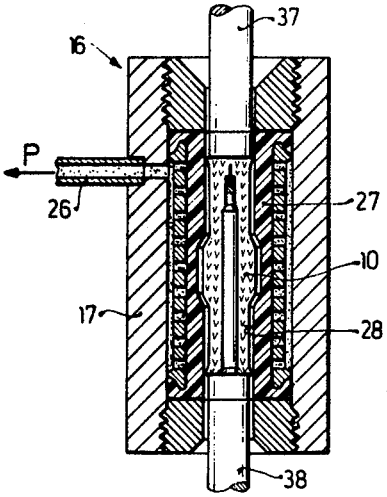

Third step (FIG. 4): The upper plug 37 is moved downwardly so that its head ring 39 extends into the upper end portion of the elastic mold 27. The extension into the elastic mold 27 of the two plugs 37, 38 may vary and is not critical; the position shown in FIG. 4 is preferred. The location of the plugs for any given series of spark plug insulator — center electrode subassemblies, however, should remain the same and, once set, should be accurately maintained. The extension of the two plugs into the elastic mold 27 should be to such an extent that the ceramic material 24 which already is within the space 28 is pre-compressed.

Fourth step: The hydraulic system is now pressurized from source P. A preferred pressure is in the order of about 300 bar. As a result, the elastic mold 27 is radially compressed, as a result compressing the ceramic material 24 therein. The original, unstressed ceramic in the chamber 28 within the mold 27 is so shaped that, upon compression, the desired shape of the press body 10 is obtained. Application of hydraulic pressure through duct 26 is shown by the multiple arrows in FIG. 4.

Fifth step: Pressure from source P is released; mold 27, due to its rubbery elastic properties will re-form and will go back to its original shape, so that a slight distance between the inner surface of mold 27 and the shaped ceramic element 10 will result. This is schematically illustrated by the reversal of the pressure arrow P. Hydraulic liquid can be actually withdrawn to assist in re-shaping and expansion of the mold 27.

Sixth step: The upper plug 37 is withdrawn to its upper limiting position. The lower plug 38 is moved out of the form body 17, for example upwardly (although it can also be moved downwardly). It is moved into the position which it had in the initial step, shown in FIG. 2. The press body 10, with the center electrode 11 inserted and compressed thereinto, now can be removed from the needle 42, and will have the desired shape. The center electrode 11 remains within the ceramic and can readily be removed from the holding opening 44 within the needle extension 42.

As a final step in the manufacture, the press body 10 is ground to the profile 10' (FIG. 1). This step is known and customary. Thereafter, the press body, as ground, is sintered. Any remnants of ceramic material which might have remained on the center electrode tip after first grinding can be removed therefrom after sintering by addtional grinding.

The center electrode 11 may be made of platinum, or a platinum-type metal, as well as of other metals. The metals to be selected should have a coefficient of expansion which matches that of the ceramic. If metals are inserted in the ceramic, diameters of up to only 1 mm are preferred; with some metals, diameters of up to 0.5 mm only are possible, depending on the relative coefficients of expansion of the metal and of the ceramic. For diameters greater than 0.5 mm, preferred materials for the center electrode 11 are conductive ceramic or Cermet electrodes which permit matching of the thermal coefficient of expansion to the ceramic material of the insulator. This is required to prevent the formation of cracks or fissures. The metal itself must be capable of withstanding the heat and effects of arc-over upon sparking within the severe environment of the explosive atmosphere in the cylinder head of an internal combustion engine.

The pressure source P, preferably, provides hydraulic pressure; pneumatic pressure may also be used, or a hybrid system using different forms of pressure for pressure transfer. The required pressure within the mold body 16 should be more than 250 bar; preferably it is between 300 and 400 bar.

Various changes and modifications may be made within the scope of the inventive concept.

I claim:

1. Method of attaching a center electrode (11) to a ceramic insulator body (10) of a spark plug by embedding the center electrode in the end portion of the unfired, pre-formed ceramic insulator material formed with a central bore to provide communication with the inner end of the center electrode with the central bore and permit electrical connection through the central bore to the center electrode comprising, the sequential steps of providing a movable plug element (38) having a needle-like extension (42) formed with a hollow end portion (43, 44), and providing an elastic tubular press mold (27);

inserting the end portion of the center electrode (11) which is to form the inner or connecting end into the hollow end portion (44) of the needle-like extension, while the plug element (38) is removed from the tubular mold (27);

inserting the plug element (38) within the tubular mold, the needle-like extension (42) extending into the inner chamber formed by the tubular opening of the tubular mold, the plug element (38) closing off said tubular mold (27);

introducing a measured predetermined quantity of pulverized, granular or powdery ceramic (24) through the still remaining opening of the tubular mold to fill the chamber (28) formed by the tubular mold as closed off by the plug (38), with said ceramic material;

inserting a second plug (37) into the free opening to close off the fill opening of the tubular mold;

applying radially inwardly directed pressure from the outside on the elastic tubular mold to transfer radially inwardly directed pressure to the ceramic insulating material introduced into the tubular mold, with the needle-like extension of the first plug (38) and the electrode tip (11) inserted therein;

releasing the pressure on the outside of the tubular elastic mold (11);

withdrawing both said plugs from the tubular mold, the ceramic insulator press form remaining on the needle-like extension (42) with the center electrode tip pressed therein;

and removing the insulator press form with the center electrode (11) compressed therein from the end bore (44) of the needle-like extension (42).

2. Method according to claim 1, further comprising the step of grinding the raw insulator press (10) with the center electrode (11) press-embedded therein to a predetermined shape (10') before sintering or firing the insulator press with the center electrode therein.

3. Method according to claim 1, further comprising the step of removing ceramic insulating material from the portion of the insulator press adjacent the center electrode (11) after firing or sintering of the insulator press body with the center electrode (11) press-embedded therein.

4. Method according to claim 1, wherein the center electrode (11) comprises platinum or platinum metal having a diameter of less than 1 mm.

5. Method according to claim 4, wherein the diameter of the center electrode is up to about 0.5 mm.

6. Method according to claim 1, wherein the center electrode (11) comprises at least one of the materials: electrically conductive ceramic; Cermet, said material having a thermal coefficient of expansion matching approximately the thermal coefficient of expansion of the ceramic material (24).

7. Method according to claim 1, wherein the step of applying pressure in radially inwardly directed form to the elastic mold (27) comprises providing a prssure-resistant housing (17) and inserting said elastic tubular mold body (27) within said housing;

and subjecting the outside of the elastic tubular body within the housing to fluid pressure.

8. Method according to claim 7, wherein the fluid pressure is in the order of between 250 to 400 bar.

* * * * *